US008083093B2

(12) United States Patent
McCumber

(10) Patent No.: US 8,083,093 B2
(45) Date of Patent: Dec. 27, 2011

(54) PLASTIC CONTAINER WITH PIVOTING BOTTOM WALL PORTIONS

(75) Inventor: Donald E. McCumber, Madison, WI (US)

(73) Assignee: Placon Corporation, Madison, WI (US)

( * ) Notice: Subject to any disclaimer, the term of this patent is extended or adjusted under 35 U.S.C. 154(b) by 0 days.

(21) Appl. No.: 12/883,872

(22) Filed: Sep. 16, 2010

(65) Prior Publication Data

US 2011/0000911 A1 Jan. 6, 2011

Related U.S. Application Data

(62) Division of application No. 11/317,035, filed on Dec. 22, 2005, now Pat. No. 7,823,746.

(51) Int. Cl.
*B65D 1/42* (2006.01)

(52) U.S. Cl. ... 220/675; 220/4.21; 220/4.24; 220/212.5; 220/657; 220/659; 220/669; 220/780; 220/789; 220/790; 220/793; 220/802; 426/106; 426/129

(58) Field of Classification Search ..... 220/4.21, 220/4.24, 212.5, 657, 659, 669, 675, 780, 220/789, 790, 793, 802; 426/106, 129
See application file for complete search history.

(56) References Cited

U.S. PATENT DOCUMENTS 2,866,575 A 12/1958 Lattuca
D341,316 S 11/1993 Fritz et al.
5,456,379 A 10/1995 Krupa et al.
5,607,709 A 3/1997 Fritz et al.
D394,807 S 6/1998 Krupa et al.
6,257,401 B1 7/2001 Mangla et al.
6,349,847 B1 2/2002 Mangla et al.
6,619,501 B2 9/2003 Hayes et al.
D488,718 S 4/2004 Passerini
6,786,351 B2 9/2004 Krueger

OTHER PUBLICATIONS

Exhibit A—Photograph of Reynolds Rotisserie Chicken Container, May 2005.
Exhibit B—Photograph of Plastic Ingenuity, Inc. Container, Prior to 2006.
Plastic Ingenuity "Latchables" web page print-out http://www.plasticingenuity.com/products/latchables.htm Nov. 10, 2005.
Photograph of underside of rotisserie chicken tray available prior to Mar. 8, 2005.

*Primary Examiner* — Anthony Stashick
*Assistant Examiner* — Elizabeth Volz
(74) *Attorney, Agent, or Firm* — Stiennon & Stiennon

(57) ABSTRACT

A container has a base with a bottom wall rib structure which deforms downwardly when an unresisted load is applied. The rib structure stiffens the base, and also can elevate the food product from liquid within the container. The bottom wall has a central platform which extends upwardly from a lower encircling segment. The lower encircling segment marks the lowermost portion of the base as molded, and extends inwardly from the lower margin of the sidewall. Two generally parallel longitudinal ribs extend across the platform and project upwardly from the platform. The longitudinal ribs extend from the lower encircling segment at the front of the base to the rear of the base. Short bridging ribs are evenly spaced parallel to one another and extend laterally between and connect the two longitudinal ribs. A plurality of cross ribs extend outwardly from each longitudinal rib to the encircling segment.

13 Claims, 6 Drawing Sheets

PLASTIC CONTAINER WITH PIVOTING BOTTOM WALL PORTIONS

CROSS REFERENCES TO RELATED APPLICATIONS

This application is divisional application of U.S. application Ser. No. 11/317,035, filed Dec. 22, 2005, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to enclosed plastic containers in general, and to containers for food products in particular.

Restaurants, deli counters, and caterers provide convenience and time savings to their customers by preparing various dishes within their facilities for customers to take out for dining within the customer's home. Many of these dishes are cooked and maintained in a heated condition after preparation, until time of sale. The customer purchases the food item while still hot or warm, and will then take the item home.

Warm food products present a special challenge to point of sale packaging. First, because of the temperature difference between the food product and ambient conditions, there is bound to be vapor condensation on any cool container into which the product is placed. Second, if the food product is significantly elevated in temperature, it is desirable to keep the hot product from uncomfortable contact with the user. Moreover, any juices or condensate should be securely retained within the container. In some containers formed from thermoformed plastic sheet, strap handles are provided which fold up from the container base. However, when these straps extend so as to present the narrow thickness of the strap pointing downwards, all of the package weight is carried on the user's hands through a very small surface area of the user's hand, reducing the comfort of carrying the loaded container.

Rotisserie chicken is an example of a food item sold hot. The hot chicken is removed from a spit or warming rack and is placed into a container, for example a two part thermoformed plastic one. Typically the container has a lid which is pressed into engagement with a base so as to form a peripheral seal around the container. What is needed is a container which is readily assembled by food service personnel, and which can accommodate condensate liquids. Moreover, the container should be conducive to carrying by the customer without requiring too close contact with the heated food item.

SUMMARY OF THE INVENTION

The container for this invention is suited for carry out heated food items, such as rotisserie chicken, and has a base which is connected to a lid by a mating peripheral closure which defines a liquid tight seal. The closure has an encircling inclined wall on the base, which helps to direct the lid into engagement with the base, and which also defines a cavity within the closure which can retain liquid. The base may be provided with two fold up straps which are retained by structure in the lid to lie generally flat to serve as a convenient carrying handle above the lid. The base has a bottom wall with rib structure allowing it to distend downwardly when loaded with food to space the heated food from the customer's hand while engaged with the handle.

It is an object of the present invention to provide a container for heated food items which can be readily assembled from two parts.

It is a further object of the present invention to provide a container for heated food items which can be carried in such a way as to avoid too close contact with the food.

It is an additional object of the present invention to provide a container for heated food products which retains liquids.

Further objects, features and advantages of the invention will be apparent from the following detailed description when taken in conjunction with the accompanying drawings.

DESCRIPTION OF THE PREFERRED EMBODIMENTS

Figure 1:
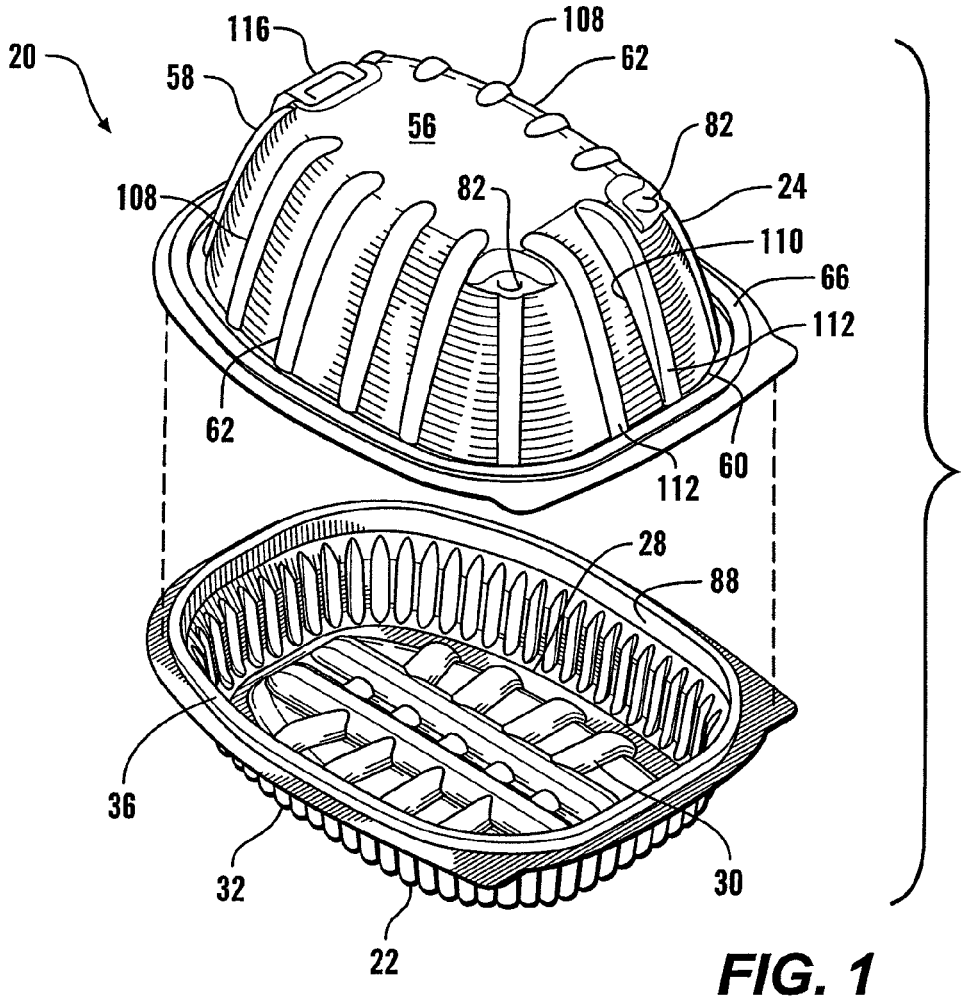
FIG. 1 is an exploded isometric view of a container of this invention.
Figure 2:
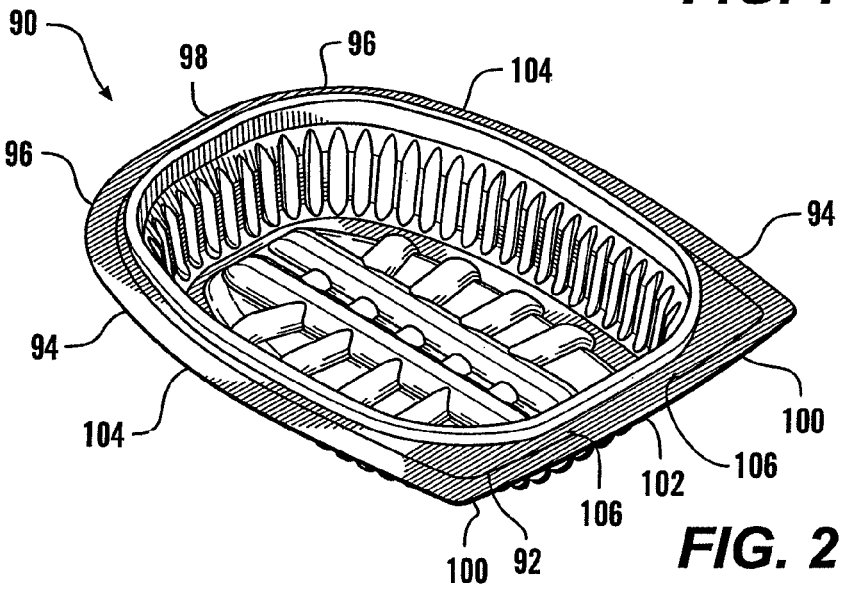
FIG. 2 is an isometric view of the base of an alternative container of this invention having retention handles.

Referring more particularly to FIGS. 1-9, wherein like numbers refer to similar parts, a container 20 having a tray or base 22 with a mating lid 24 is shown in FIG. 1. Both the base 22 and the lid 24 are preferably formed in the thermoforming process from thin sheets of plastic material, for example polypropylene. Preferably the extruded sheet from which the lid 24 is formed will be passed through a rolling bath coater to apply a defogger to the interior. The container 20 may be used for containing heated food items, and the illustrated embodiment is a rotisserie chicken container, such as will commonly be used at a deli counter. In common use a cooked chicken will be taken from a rotisserie and placed directly in the base 22. The lid 24 is then pressed on to the base 22, and held to the base by a closure 26. The closure 26 is comprised of cooperating molded structures on the base 22 and the lid 24.

Figure 3:
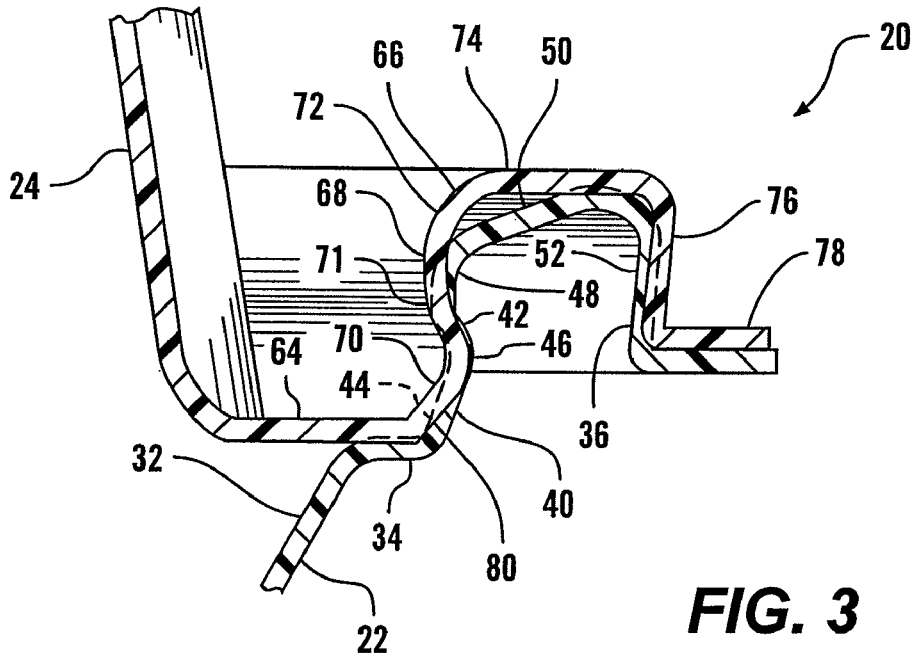
FIG. 3 is a schematic cross-sectional view of the closure of the container of FIG. 1 showing closure portions of the undeformed lid superimposed over closure portions of the undeformed base.
Figure 4:
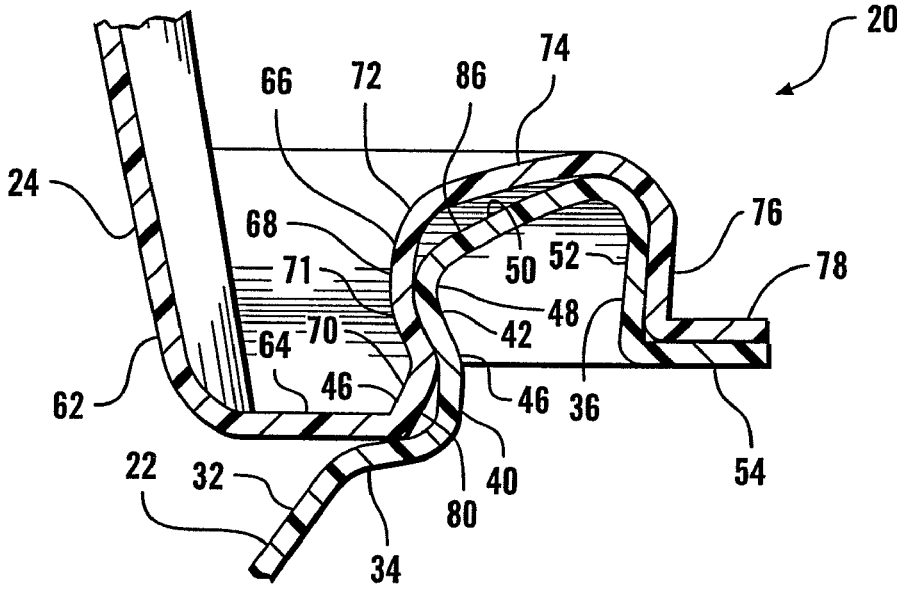
FIG. 4 is an enlarged fragmentary cross-sectional view of the closure of the container of FIG. 1.

As shown in FIG. 1, the base 22 has a bottom wall 28 with an inwardly protruding rib structure 30 formed therein. A fluted side wall 32 extends upwardly from the bottom wall 28 and is terminated by a narrow peripheral inside flange 34. A peripheral closure projection 36 extends upwardly from the inside flange 34, and is terminated by a peripheral outside flange 54. As shown in FIGS. 3 and 4, the closure projection 36 has a first segment 40 which extends upwardly and outwardly from the inside flange 34, and a second segment 42 which extends inwardly and upwardly from the first segment. The inside flange 34, the first segment 40, and the second segment 42, define a peripheral recess 44 which receives a protrusion 46 formed on the lid 24 and discussed more fully below. A third segment 48 extends upwardly from the second segment 42, and is joined to an upper wall 50 which extends upwardly and outwardly and which is joined at a radius to an outside wall 52. The outside wall 52 extends downwardly from the upper wall, and is formed with an undercut so that it extends slightly inwardly. An outside flange 54 extends outwardly from the base of the outside wall 52.

The lid 24 is preferably formed of transparent or semitransparent plastic, and has a top wall 56 with downwardly and outwardly extending side walls comprised of a front wall 58 and a rear wall 60 joined by two side walls 62. The side walls are terminated by a continuous peripheral inside flange 64. A peripheral closure cap 66 projects upwardly from the inside flange. The closure cap 66 has an inside wall 68 comprised of a first segment 70 which extends upwardly and outwardly from the inside flange 64, a second segment 71 which extends upwardly and inwardly from the first segment, and a third segment 72 which extends upwardly from the second segment to form a radiused transition to a generally horizontal and outwardly extending upper wall 74. An outside wall 76 extends downwardly from the upper wall 74, and is formed as an undercut, so that it extends somewhat inwardly beneath the upper wall. A horizontal outside flange 78 extends outwardly from the outside wall 76.

The lid cap 66 and the base projection 36 together form the closure 26 when the lid 24 is pressed onto the base 22. When the lid 24 first engages the base 22, generally the lowest portion of the lid, that is the inside flange 64 and the inside wall 68, touches the inwardly inclined upper wall 50 of the base projection 36. This inclined upper wall 50 serves to direct the lid portions inwardly as downward pressure is applied, with the result that the lid is self-centering and directed into a sealed condition on the base. This structure facilitates the placing of the lid on the base, and the sealing of the closure by a worker using only one hand. The inside wall 68, with the outwardly extending protrusion 80 formed by the first segment 70 and the second segment 71, travels downwardly such that the protrusion 80 engages within the recess 44 defined between the base inside flange 34, the base first segment 40, and the base second segment 42. It is this engagement which defines the primary liquid tight seal between the base 22 and the lid 24. A secondary seal is provided by the engagement between the undercut lid cap outside wall 76 and the base projection outside wall 52. The outside flanges 54, 78, engage against each other when the lid is fully seated on the base. Although the closure 26 is generally liquid tight, it should be noted that the entire container is not fully liquid tight, because the lid is preferably provided with vent slits 82, as shown in FIG. 1, to allow the escape of hot gases.

Figure 7:
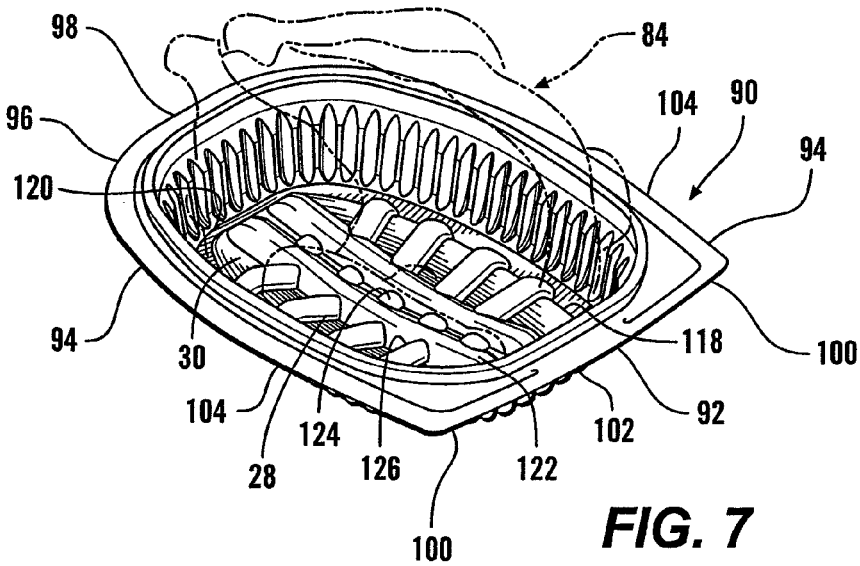
FIG. 7 is an isometric view of the base of the container of FIG. 2, deformed by the weight of a rotisserie chicken contained therein and shown in phantom view.
Figure 8:
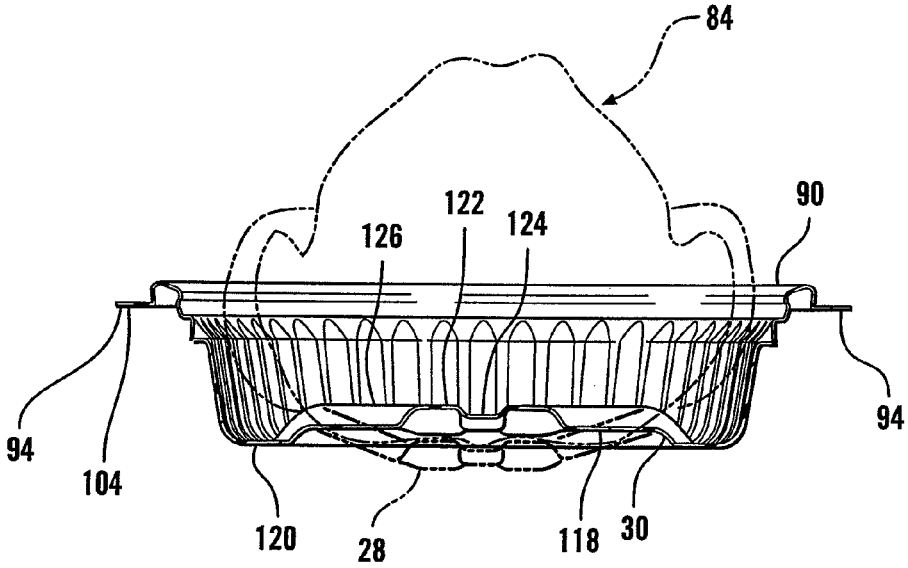
FIG. 8 is a cross-sectional view of the container of FIG. 6, taken along section line 8-8, with the deformed loaded container with rotisserie chicken contained therein shown in phantom view.

Because the food contents of the container 20, such as the rotisserie chicken 84 shown in FIGS. 7 and 8, is usually hot and moist when it is placed in the container, there is a tendency for condensation to form on the cool plastic of the base and lid, and for juices or other moisture to fall onto the base as the food is inserted in the container, and the lid placed on the base. Because the customer will handle the loaded container 20, it is desirable that, as much as possible, liquids be kept from the exterior of the container. The structure of the closure 26 contributes to this goal by providing a sealed cavity 86 defined between the inside wall 68 and the upper wall 74 of the lid closure cap 66 and the base closure projection 50. First, liquids deposited or condensed on the inclined base closure projection upper wall 50 will tend to be pushed into the interior 88 of the base 22 by the downward movement of the lid cap inside wall and inside flange as the lid is closed on the base. Second, the cavity 86 provides a volume to retain liquids or water vapors trapped between the base closure projection 50, and the lid closure cap 66, preventing such liquids from being forced outwardly from the closure onto the exterior of the container.

Figure 5:
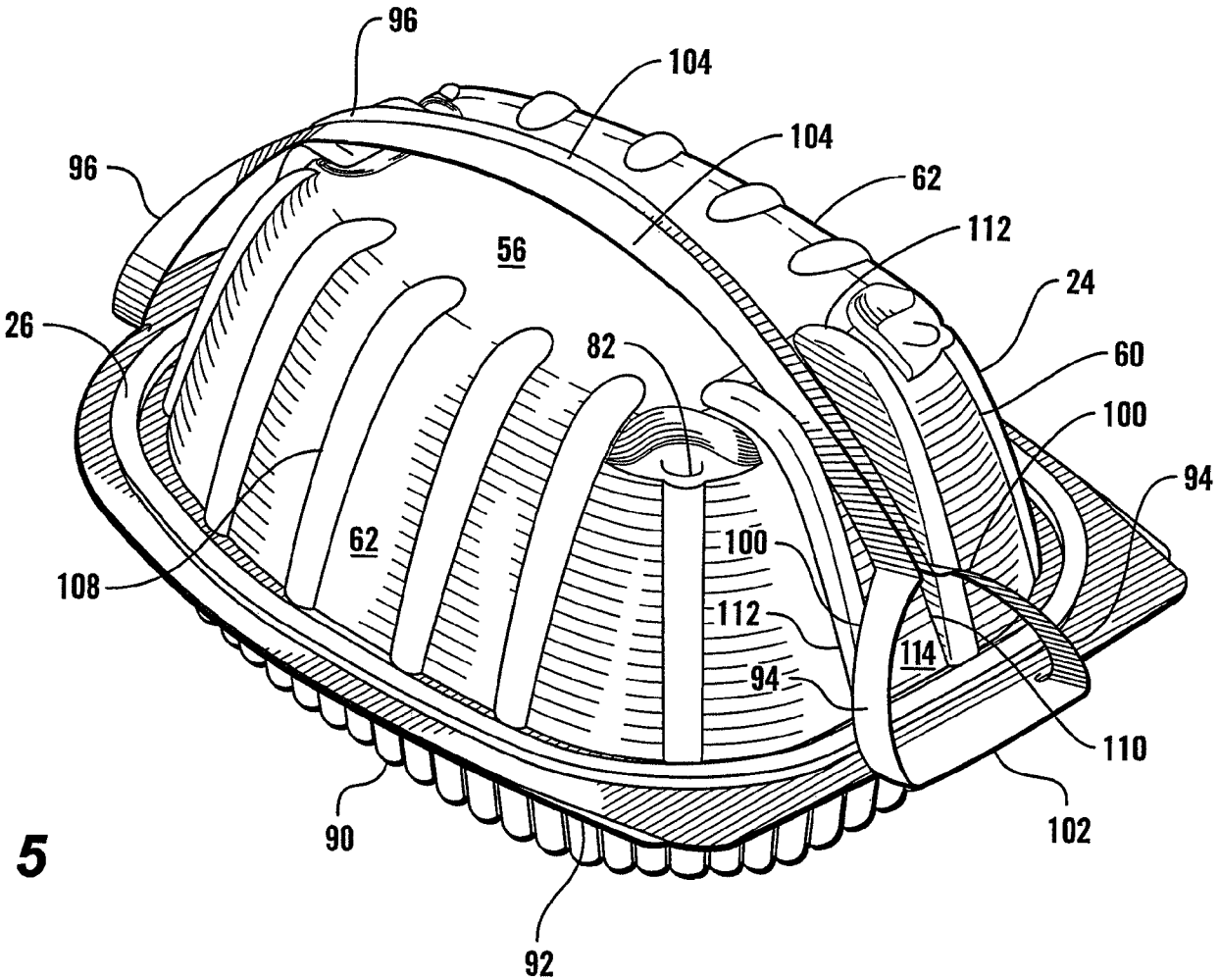
FIG. 5 is a perspective view of the base of FIG. 2 engaged with a container lid.
Figure 6:
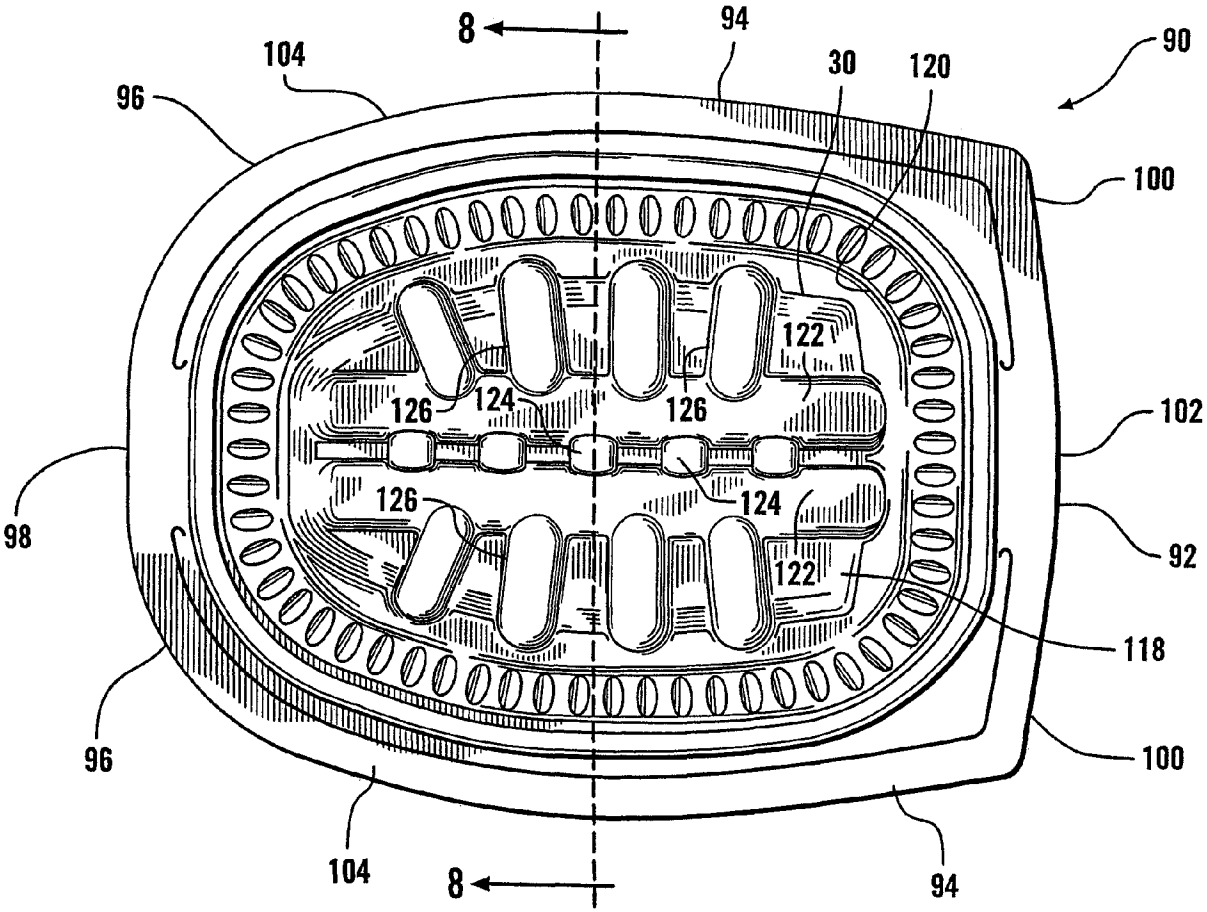
FIG. 6 is a top plan view of the base of the container of FIG. 2.

An alternative embodiment base 90, shown in FIGS. 2 and 5-8, is identical to the base 22 discussed above, except that the base outside flange 92 is wider, and is die cut to define two handle straps 94 which extend from the front to the rear of the container. As shown in FIG. 6, the handle straps 94 are of generally constant width and follow the peripheral contour of the base 90. Thus each base hand strap 94 has three segments: a front segment 96 which extends from a front portion 98 of the base outside flange, a rear segment 100 which extends from the rear portion 102 of the base outside flange 92, and a connecting segment 104 which extends between the front segment 96 and the rear segment 100. It will be noted that the base outside flange is deeper at the front portion 98 and the rear portion 102, because there is no strap cut away there. The handle straps 94 preferably have a semicircular anti-tear cut 106 where they join the base outside flange front portion 98 and rear portion 102, to limit tearing of the plastic in those regions which would tend to separate the handle straps from the base.

As shown in FIG. 5, once the container is loaded with the food item 84, and the lid 24 is closed on the base, the handle straps 94 are lifted up from the base and forced over the ribs 108 which protrude from the lid side walls 62. The connecting segments 104 of the straps 94 are then received within a recess 110 defined between two ribs 112 which protrude from the rear wall 60. The rear wall ribs 112 extend upwardly and project above the lid top wall 56. The recess 110, however, has a surface 114 which terminates at or about at the same level as the lid top wall 56. The ribs 112 are preferably positioned closer to one another than the combined widths of the straps 94, causing the straps to overlap one another as they extend across the top wall 56 of the lid 24. The effect is that the straps 94 extend across the lid top wall 56 with the width of the straps facing toward the top wall. The straps 94 are then slightly spaced from the lid top wall to readily permit a customer's fingers to be inserted beneath the straps 94 to lift the container 20. Because the straps 94 are generally horizontal as they extend across the lid top wall, there is a larger surface area to engage the customer's fingers, and thus there is less tendency of the plastic to press into the customer's hands or cause discomfort. The straps 94 may be about one half inch wide. The straps will preferably be between about 0.015 to 0.025 inches thick.

The lid 24 may have a frontwardly protruding label bubble 116 extending from the front wall 58 of the lid. As the straps 94 extend down along the lid front wall 58, they may engage opposite sides of the bubble 116 as they extend to the front portion 98 of the base peripheral outside flange 92.

It should be noted that although the structures of the invention have been illustrated as part of a rotisserie chicken container, the inventive features may also be incorporated in rectangular or circular containers, or other shaped food containers.

As shown in FIGS. 6-8, the container base 90 is preferably formed with a bottom wall 28 rib structure 30 which deforms downwardly when an unresisted load is applied. Dimensions will be given for the illustrated embodiment, which has a bottom wall about 7¾ inches long from front to back, and about 5½ inches wide from side to side, although other container types according to the invention may vary in dimension. The rib structure 30 stiffens the base 90, and also can elevate the food product from liquid within the container. The bottom wall has a central platform 118 which extends upwardly from a lower encircling segment 120 about ¼ inch. The lower encircling segment 120 marks the lowermost portion of the base 90 as molded, and extends inwardly from the lower margin of the sidewall 32. The platform 118 has roughly the same shape as the bottom wall, but is spaced inwardly about one inch from the side wall 32 to generally engage the lid top wall 56 when set upon a similar container. Two generally parallel longitudinal ribs 122 extend across the platform 118 and project upwardly about ¼ inch from the platform. The longitudinal ribs 122 extend from the the lower encircling segment 120 at the front of the base to the rear of the base. Short bridging ribs 124 are evenly spaced parallel to one another and extend laterally between and connect the two longitudinal ribs 122. The bridging ribs are about one-half inch wide and extend above the level of the platform about ¼ inch, but not as high as the longitudinal ribs. A plurality of cross ribs 126 extend outwardly from each longitudinal rib 122 to the encircling segment 120. The cross ribs 126 protrude upwardly from the platform 118 about the same height as the longitudinal ribs, but extend outwardly from the platform to the encircling segment 120.

The function of the bottom wall rib structure 30, as shown in FIGS. 7 and 8, is to deflect or pivot downwardly when a sufficient load is applied to the longitudinal ribs and the cross ribs. For example, when a chicken 84 is placed within the base 22, the longitudinal ribs are pivoted downwardly, and the cross ribs pivot from the encircling segment 120. The effect of this downward pivoting is to increase the volume retained within the base, and thereby either allow a larger chicken to be contained in the base, or allow a greater distance between the top of the chicken and the handle straps 94, thus helping to space the heated contents of the container more distantly from the hands of the purchaser who is carrying the container. It will be noted that when the bottom wall rib structure is supported on a supporting surface, the full deflection will not occur until the container is lifted off the supporting surface.

Figure 9:
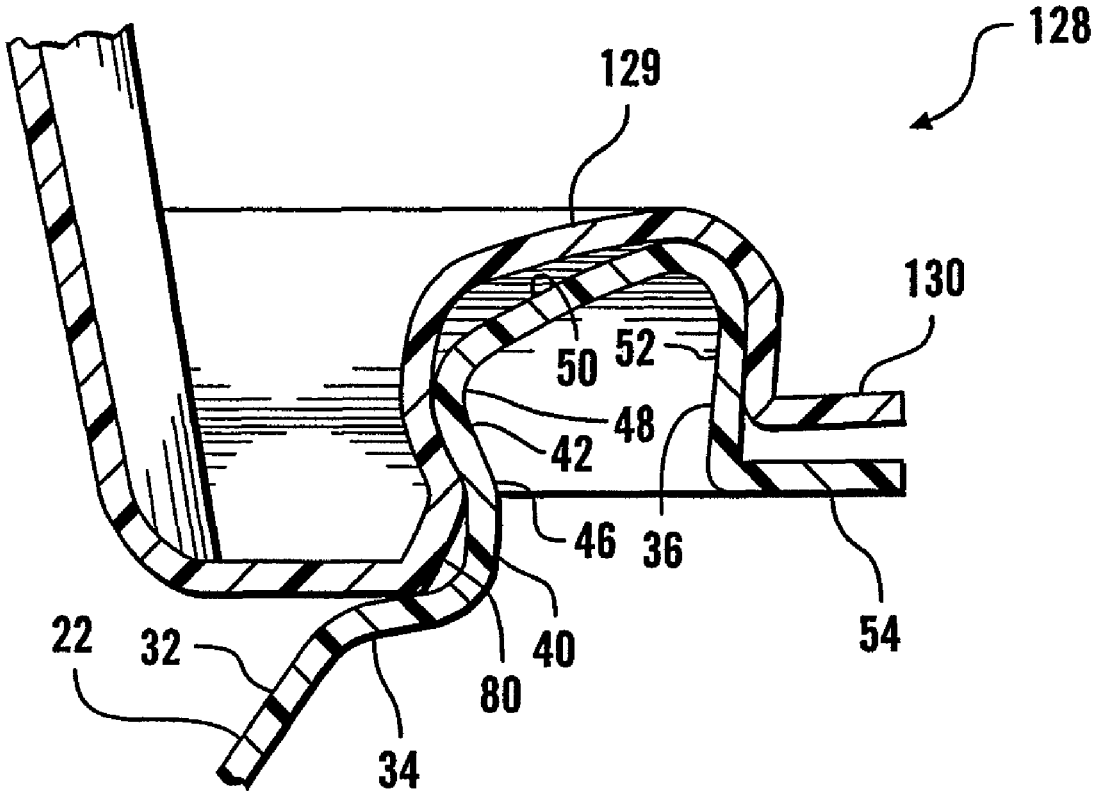
FIG. 9 is a fragmentary cross-sectional view of an alternative embodiment container having a gap between the base and lid flanges for aid in separation.

An alternative embodiment container 128, shown in FIG. 9, has a lid 129 substantially the same as the lid 24 discussed above, with the difference that a lid horizontal outside flange 130 is spaced above the base outside flange 54 in a closed condition, to facilitate separation of the lid from the base. The spacing may be approximately the thickness of the plastic sheet from which the lid is formed.

It is understood that the invention is not limited to the particular construction and arrangement of parts herein illustrated and described, but embraces all such modified forms thereof as come within the scope of the following claims.

I claim:

1. A container, comprising:

a thermoformed base, the base having a bottom wall with a side wall extending upwardly therefrom, a volume being defined within the base between the side wall and the bottom wall;

portions of the bottom wall which define a lower encircling segment;

portions of the bottom wall which define a platform which extends upwardly from the lower encircling segment;

portions of the bottom wall which define a longitudinal rib structure having a longitudinal rib which extends upwardly from the platform;

a plurality of cross ribs extending from the longitudinal rib structure across the platform to the lower encircling segment, wherein a load applied to the longitudinal rib structure causes portions of the bottom wall to pivot downwardly to increase the volume retained within the base.

2. The container of claim 1 wherein the container is rectangular.

3. The container of claim 1 wherein the container is circular.

4. The container of claim 1 further comprising a food item supported on the base, the food item comprising the load applied to the longitudinal rib structure.

5. The container of claim 1, further comprising handle straps which extend from the base.

6. The container of claim 1 further comprising a lid which is releasably connected to the base.

7. The container of claim 6, further comprising:

a peripheral flange which extends outwardly from the base side wall to encircle the base;

portions of the lid which define a front wall and a rearwardly spaced rear wall joined by side walls which extends downwardly from a top wall;

a first handle strap which extends from the flange, and which is connected to a front and a rear of the base;

a second handle strap which extends from the flange, and which is connected to the front and the rear of the base;

portions of the plastic lid which define two upwardly extending ribs, the ribs being spaced from each other to define a recess therebetween, wherein the handle straps when lifted up so that portions of the straps extend over the top wall of the lid, portions of the first handle strap and the second handle strap are then received within the recess, such that the straps extend across the lid top wall such that a user's fingers are insertable beneath the straps to lift the container.

8. The container of claim 1 wherein the longitudinal rib structure comprises:

portions of the bottom wall which define two longitudinal ribs which extend upwardly from the platform; and a plurality of bridging ribs which extend laterally between the two longitudinal ribs and which extend upwardly from the platform.

9. The container of claim 8 wherein the two longitudinal ribs are parallel to one another.

10. The container of claim 9 wherein the bridging ribs are parallel to one another and perpendicular to the longitudinal ribs.

11. A container including a food item comprising:

a thermoformed base, the base having a bottom wall with a side wall extending upwardly therefrom, a volume being defined within the base between the side wall and the bottom wall;

portions of the bottom wall which define a lower encircling segment;

portions of the bottom wall which define a platform which extends upwardly from the lower encircling segment;

portions of the bottom wall which define a first longitudinal rib and a second longitudinal rib which extend upwardly from the platform;

a plurality of bridging ribs which extend laterally between the two longitudinal ribs and which extend upwardly from the platform; and a plurality of cross ribs extending from the first longitudinal rib across the platform to the lower encircling segment;

a plurality of cross ribs extending from the second longitudinal rib across the platform to the lower encircling segment, wherein a load applied to the two longitudinal ribs causes portions of the bottom wall to pivot downwardly to increase the volume retained within the base.

12. The container of claim 11 further comprising a lid releasably engageable with the base to overlie the bottom wall.

13. The container of claim 12 wherein the cross ribs extend upwardly from the platform about the same height as the longitudinal ribs.

* * * * *